US011633871B2

(12) United States Patent
Ross

(10) Patent No.: US 11,633,871 B2
(45) Date of Patent: Apr. 25, 2023

(54) LINEAR CUT TO LENGTH SYSTEM FOR INLINE PRODUCTION OF PROCESSED TUBING

(71) Applicant: Engineering Resources Group, Inc., Pembroke Pines, FL (US)

(72) Inventor: Christopher Ross, Davie, FL (US)

(73) Assignee: Engineering Resources Group, Inc., Pembroke Pines, FL (US)

( * ) Notice: Subject to any disclaimer, the term of this patent is extended or adjusted under 35 U.S.C. 154(b) by 63 days.

(21) Appl. No.: 17/338,140

(22) Filed: Jun. 3, 2021

(65) Prior Publication Data

US 2021/0379784 A1 Dec. 9, 2021

Related U.S. Application Data

(60) Provisional application No. 63/034,217, filed on Jun. 3, 2020.

(51) Int. Cl.

| | |
|---|---|
| ***B26D 3/16*** | (2006.01) |
| ***B26D 7/02*** | (2006.01) |
| ***B65H 49/00*** | (2006.01) |
| *B26D 5/08* | (2006.01) |
| *B26D 7/01* | (2006.01) |

(52) U.S. Cl.

CPC ..... *B26D 3/16* (2013.01); *B26D 7/02* (2013.01); *B65H 49/00* (2013.01); *B26D 5/086* (2013.01); *B26D 2007/013* (2013.01)

(58) Field of Classification Search

CPC . B26D 3/16; B26D 3/165; B26D 7/02; B26D 2007/013

USPC ..... 83/206, 277

See application file for complete search history.

(56) References Cited

U.S. PATENT DOCUMENTS 3,714,698 A * 2/1973 Fukuroi ..... A44B 19/62 29/408
4,524,656 A * 6/1985 Del Fabro ..... B23D 23/00 83/277
4,615,246 A * 10/1986 Yoshieda ..... D06H 7/02 83/277

(Continued)

OTHER PUBLICATIONS

PTL BV, "NEXA Expansion Line", pp. 1-7, date unknown.

(Continued)

*Primary Examiner* — Jennifer S Matthews
(74) *Attorney, Agent, or Firm* — The Concept Law Group, PA; Scott M. Garrett; Scott D. Smiley

(57) ABSTRACT

A system for cutting medical tubing sourced from a spool of tubing uses two actuator groups that each reciprocate along a respective track, which are parallel to each other. Each actuator group has a clamp and a cutting tool which have an operative position along a common axis. The tubing is fed along the common axis to be operated on by the actuator groups. A forward actuator group clamps onto the tubing and is then moved along its track, pulling the tubing. A rearward actuator group then clamps onto the tubing and cuts the tubing. While still clamped onto the tubing, the rearward actuator group is moved forward, pulling more tubing, and the actuator group that was forward is moved to the rearward position and the process is repeated iteratively to produce tubing sections cut to the desired length. The tubing is pressurized and kept under pressure to straighten the tubing.

15 Claims, 11 Drawing Sheets

(56) References Cited

U.S. PATENT DOCUMENTS

| | | | | |
|---|---|---|---|---|
| 5,205,196 | A * | 4/1993 | Blaimschein | B26D 7/20 83/272 |
| 2008/0202299 | A1 * | 8/2008 | Kudrus | B23D 21/04 83/284 |

OTHER PUBLICATIONS

Arno Kok, "heatshrinkable tubing expansion Line Inhol BV PTL", downloaded at https://www.youtube.com/watch?v=_9W_pLGc8R4, uploaded to YouTube on Feb. 24, 2011.

* cited by examiner

LINEAR CUT TO LENGTH SYSTEM FOR INLINE PRODUCTION OF PROCESSED TUBING

CROSS REFERENCE

This application is a non-provisional conversion of U.S. Provisional Application No. 63/034,217, filed Jun. 3, 2020, the entirety of which is hereby incorporated by reference.

FIELD OF THE INVENTION

The present invention relates generally to cutting shrink tubing that is produced on expansion equipment, and, more particularly, relates to cutting such tubing to a desired precision length for catheter applications while avoiding the problem of curvature created by storing tubing on a spool.

BACKGROUND

Fluorinated ethylene propylene (FEP) shrink tubing is a key material consumed in the production of guided or reinforced catheters. The production of FEP tubing to its ready to use state, on a spool, involves heating and pressurization of FEP tubing in a continuous process. The tubing is provided on a first spool, and to provide it in a state for use in catheters, it is internally pressurized with nitrogen and moved through an expander where it is expanded radially and cooled rapidly. The tubing that emerges from the expander is then collected on a second spool until the tubing on the first/supply spool is all processed.

The problem with spooling up the output tubing is that the tubing relaxes on the spool and adopts the curvature of the spool. The curved tubing needs to be straightened before it can be used in the production of catheters. Standard cut to length equipment currently available uses pinch rollers or rolling belts to squeeze and maintain pressure in the expanded tubing while conveying the tubing before cutting. As a result, this flattening of the tubing by the pinch rollers produces two seam edges along the tubing that adversely affects its performance as shrink tubing in the catheter production process.

Therefore, a need exists to overcome the problems with the prior art as discussed above.

SUMMARY

In accordance with some embodiments of the inventive disclosure, there is provided a linear cut to length tubing cutting system that includes a first track and a second track, wherein the first track and the second track are parallel to each other. The system also includes a first actuator group disposed on the first track, a second actuator group disposed on the second track, wherein the first and second actuator groups are movable, forward and rearward, on their respective tracks. Each actuator group having, from front to rear, a holding clamp, a cutting tool, and a sealing clamp; and wherein the first and second actuator groups are alternately moved forward and rearward on their respective tracks while engaging a pressurized tubing to iteratively cut the pressurized tubing to a desired length.

In accordance with a further feature, the holding clamp, cutting tool, and sealing clamp of each of the first and second actuator groups are moveable between an operative position and a raised position, and wherein when the first and second actuator groups are moved rearward the holding clamp, cutting tool, and sealing clamp are moved from the operative position to the raised position.

In accordance with a further feature, each of the first and second actuator groups has a non-operative end, and wherein the non-operative ends of the first and second actuator groups are angled away from each other and the operative position of the first and second actuator groups are maintained in common.

In accordance with a further feature, the holding clamp, cutting tool, and sealing clamp of each of the first and second actuator groups are mounted together on a frame that is movable by a position actuator.

In accordance with a further feature, the position actuator of each of the first and second actuator groups are mounted on a respective vertical plate that is further mounted on a carriage on the respective first and second tracks.

In accordance with a further feature, the system further includes a control unit that is operably connected to each of the first and second actuator groups, which causes the first and second actuator groups to move on the first and second tracks, respectively, to control a distance between the first and second actuator groups to a desired cut tube length.

In accordance with a further feature, the first and second tracks are mounted on a common frame.

In accordance with some embodiments of the inventive disclosure, there is provided a method for producing tubing sections for medical use. The method includes providing a first actuator group and a second actuator group that are each moveable along a linear direction parallel to each other, between a home position and a forward position. Each of the first and second actuator groups having a cutting tool and a sealing clamp, wherein the sealing clamp is rearward of the cutting tool. The method also includes feeding tubing between the first and second actuator groups, and iteratively and reciprocally moving the first and second actuator groups such that one actuator group of the first and second actuator groups is moved forward to the forward position while the sealing clamp of the one actuator group is clamped onto the tubing, thereby pulling the tubing, and at the other of the first and second actuator groups which is in the home position, clamping the sealing clamp onto the tubing and cutting the tubing with the cutting tool, and then moving the one actuator group at the forward position back to the home position while the one actuator group at the home position is then moved forward.

In accordance with a further feature, the method further includes providing the tubing on a spool.

In accordance with a further feature, the method further includes pressurizing the tubing, and wherein reciprocally moving the first and second actuator groups maintains pressure in the tubing.

In accordance with a further feature, reciprocally moving the first and second actuator groups further comprises raising the cutting tool and the sealing clamp of the one actuator group at the forward position as it is moved rearward.

In accordance with a further feature, providing the first actuator group and the second actuator group comprises positioning the first and second actuator groups such that they have a common operative position with respect to the tubing, and wherein a non-operative end of each of the first and second actuator groups are angled away from each other.

In accordance with a further feature, providing the first actuator group and the second actuator group comprises providing the first actuator group and the second actuator group each further having a holding clamp that is located in front of the cutting tool, and when in the home position, clamping the holding clamp onto the tubing with the sealing clamp to hold the tubing while the cutting tool cuts the tubing.

In accordance with a further feature, feeding the tubing between the first and second actuator groups comprises passing the tubing through a feed guide.

In accordance with some embodiments of the inventive disclosure, there is provided a method for producing tubing sections for medical use. The method includes providing a cutting apparatus having a pair of actuator groups. Each of the actuator groups being moveable in a parallel linear direction, and each of the pair of actuator groups having a holding clamp, a cutting tool, and a sealing clamp, in order from front to back. The method further includes providing a roll of tubing, wherein the tubing is created by expansion, and the roll of tubing having a free end and a tail end. The method also includes connecting the tail end of the tubing to a pressurized gas source, and feeding the free end of the tubing into the cutting apparatus. The method includes, at a forward one of the pair of actuator groups, clamping at least one of the holding clamp or the sealing clamp onto the free end of the tubing, and pressurizing the tubing by the pressurized gas source. While clamping at the forward one of the pair of actuator groups, with the tubing being pressurized, the method includes moving the forward one of the pair of actuator groups along a linear track to a desired distance, thereby pulling the tubing. Upon the forward one of the pair of actuator groups reaching the desired distance, at the rearward one of the pair of actuator groups, the method includes clamping both the holding clamp and the sealing clamp of the rearward one of the pair of actuator groups onto the tubing. The method further includes, while both the holding clamp and sealing clamp of the rearward one of the pair of actuator groups are clamped onto the tubing, cutting the tubing with the cutting tool of the rearward one of the pair of actuator groups, and after cutting the tubing by the rearward one of the pair of actuator groups, while maintaining the sealing clamp of the rearward one of the pair of actuator groups clamped on the tubing, releasing the holding clamp of the rearward one of the pair of actuator groups and the sealing clamp of the forward one of the pair of actuator groups to release a cut length section of tubing. The method further includes, after releasing the holding clamp of the rearward one of the pair of actuator groups, and while maintaining the sealing clamp of the rearward one of the pair of actuator groups clamped on the tubing, moving the forward one of the pair of actuator groups rearward and moving the rearward one of the pair of actuator groups forward whereby the rearward one of the pair of actuator groups becomes the forward one of the pair of actuator groups, and the one of the pair of actuator groups that was forward become a rearward actuator group.

Although the invention is illustrated and described herein as embodied in a linear cut to length system for cutting tubing, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. To the extent that the inventive disclosure relies on or uses software or computer implemented embodiments, the terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
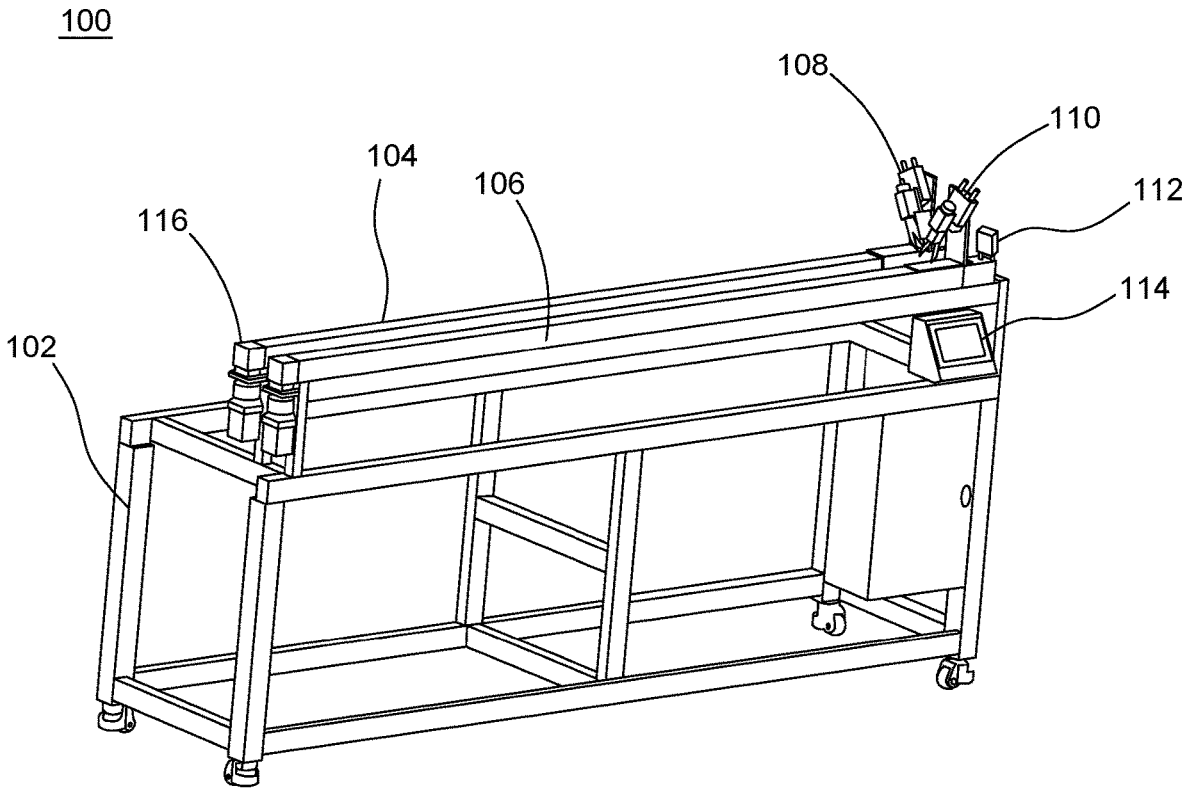
FIG. 1 is a perspective view of a linear cut to length system for cutting tubing to a desired length, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

FIG. 1 is a perspective view of a linear cut-to-length system 100 for cutting tubing to a desired length, in accordance with some embodiments. More specifically, the disclosed system is used to cut tubing that has been stored on a spool, and therefore portions of tubing cut from the spooled tubing would otherwise be disposed to being curved. The system 100 includes a support structure 102 or support frame that supports a pair of parallel tracks 104, 106, which can be horizontally oriented as shown, but in some embodiments can be oriented at an angle to horizontal, including vertically. On each one of the tracks 104, 106 is a respective actuator group 108, 110. Each of the actuator groups 108, 110 can be moved in a linear direction along its respective track 104, 106. Each actuator group 108, 110 includes a plurality of actuators that control respective tools that engage and operate on the tubing. In particular, each actuator group 108, 110 can include a controllable holding clamp, cutting tool, a sealing clamp, and a position actuator such as an extending slide, in that order, from front to back. The controllable holding clamp, cutting tool, sealing clamp, and position actuator are all electrically actuated and controllable by separate actuators, as is each actuator group's position on its respective track. The front of each actuator group 108, 110 is the portion of the actuator group 108, 110 closest to the front 116 of the system 100. A feed guide 112 is provided to guide tubing under pressure into the system 100 to be clamped and cut by the actuator groups 108, 110. A control unit 114 receives user input regarding a length to which to cut tubing, as well as the number of pieces to cut, and controls the operation and movement of the actuator groups 108, 110.

In general, the actuator groups 108, 110 alternately travel down, and back, on their respective tracks 104, 106 for each length of tubing being cut. That is, for example, actuator group 108 will clamp and hold the tubing using its sealing clamp, travel down track 104 while actuator group 110 remain in the home position substantially as shown. Then actuator group 110 clamps with both its holding clamp and sealing clamp, and cuts the tubing with its cutting tool, and, while maintaining the sealing clamp closed (clamped onto the tubing), actuator group 110 moves forward on track 106 while actuator group 108 moves rearward to the home position, and then clamps and cuts the tubing the same way actuator group 110 did in the home position. When an actuator group 108, 110 returns to its home position, as the other travels down its track from its home position, the tools of the returning actuator group are lifted by its position actuator so that the actuator group traveling down its track while holding the tubing passes under the returning actuator group. The tubing is fed into the system 100 through a guide 112 and is inflated under pressure, such as by nitrogen gas or some other gaseous fluid, being pumped into the tubing. As one actuator group moves forward, the tubing remains under pressure, and expanded, without any edge seams being formed by pinch rollers, as is used in the prior art.

Figure 2:
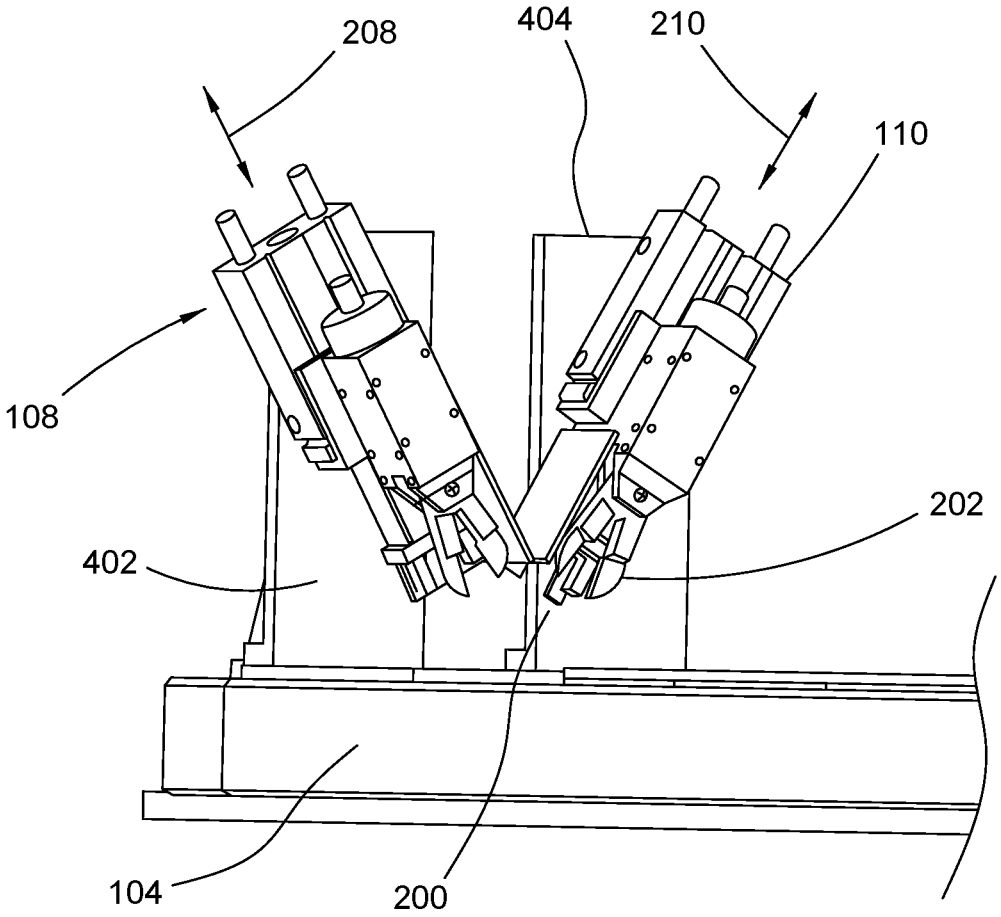
FIG. 2 is a perspective view detail of a pair of actuator groups including the clamp/cutting tools, in accordance with some embodiments.

FIG. 2 is a perspective view detail of a pair of actuator groups 108, 110 including the clamp/cutting tools that are each individually controllable, in accordance with some embodiments. As shown here, in each actuator group there is a sealing clamp 200 with a cutting tool 202 in front the sealing clamp 200. A holding clamp, which is not shown here (see FIG. 5), would be located in front of the cutting tool 202. The holding clamp is used to hold tubing when the actuator group is in the home position, when the cutting tool 202 cuts the tubing. The cutting tool 202 cuts the tubing while the tubing is secured between the holding clamp and the sealing clamp 200. The holding clamp includes two jaw members, at least one of which is movable, so that the tubing can be held fixedly between the jaw members. The holding clamp therefore applies pressure to the tubing sufficiently to move the tubing, but not with so much pressure that it distorts the shape of the tubing. The cutting tool 202 likewise includes two jaw members, at least one of which is edged for cutting the tubing. The sealing clamp 200 includes two jaw members for holding the tubing, but further to seal the tubing to prevent depressurization of the tubing. The clamps and cutting tool of each actuator group are moved in unison on the actuator group as indicated by arrows 208, 210, as well as along the tracks 104, 106 during operation of the system. In general, the clamps and cutting tool are raised by a position actuator when either of the actuator groups 108, 110 are traveling back, and then lowered to engage the tubing being processed.

Figure 3:
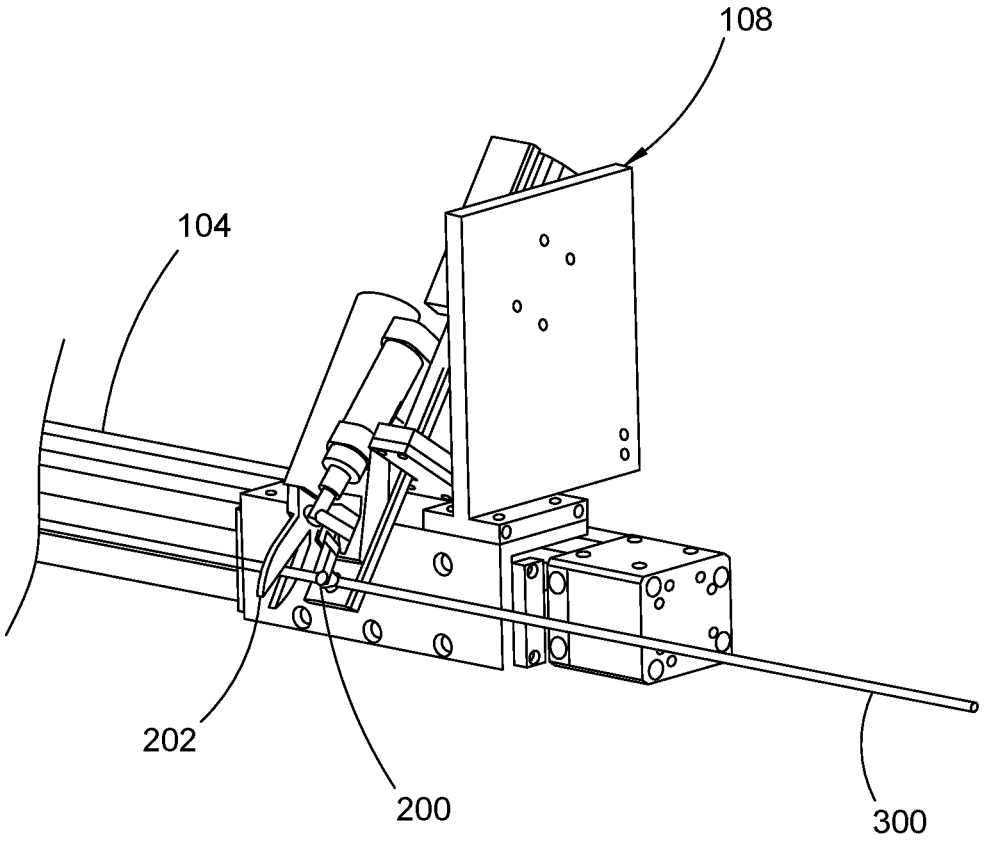
FIG. 3 is a first perspective view of a actuator group on a track, including the clamp/cutting tools, in accordance with some embodiments.
Figure 4:
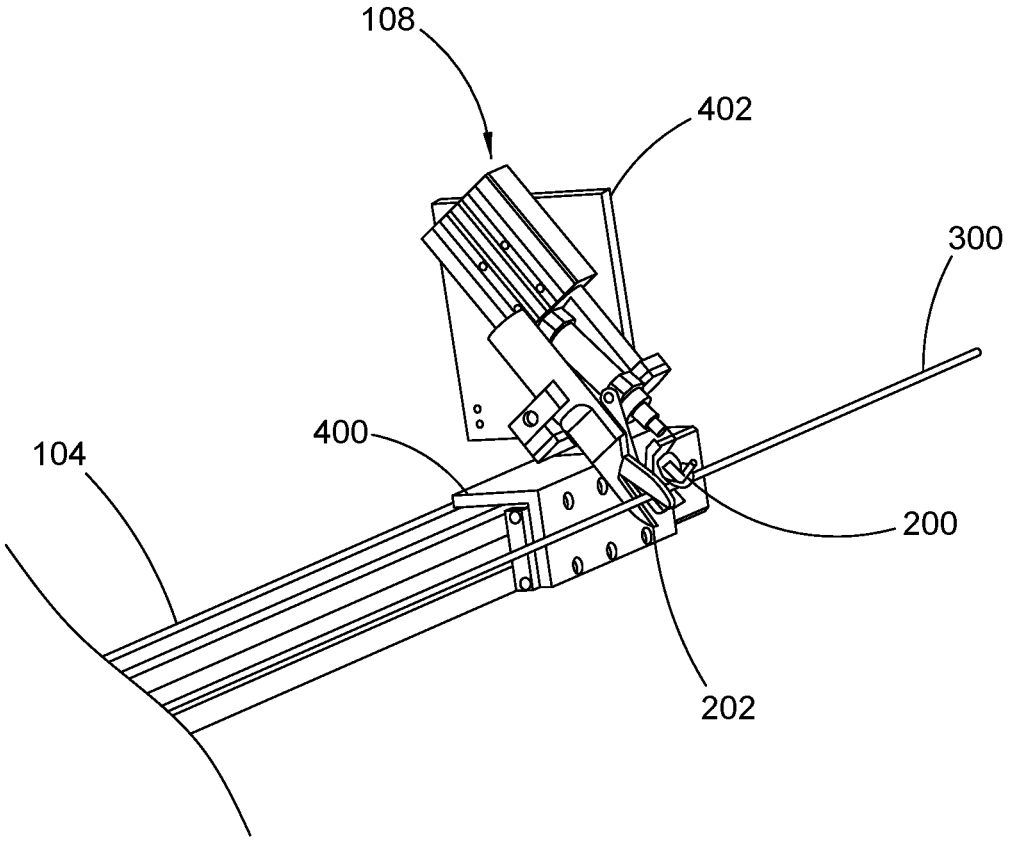
FIG. 4 is a second perspective view of a actuator group on a track, including the clamp/cutting tools, in accordance with some embodiments.

FIGS. 3 & 4 show rear and front side perspective views of one track 104 and actuator group 108, with a sealing clamp 200 and cutting tool 204 (again, lacking the holding clamp in these views). Further, in these views, a portion of tubing 300 is shown being engaged by the actuator group 108. The tubing 300 can be FEP tubing, or any other polymeric tubing that is created by expansion equipment under pressure that is cut to desired lengths. That can include, for example, polypropylene, PVC, PTFE, polyolefin, nylon, and other similar forms of tubing materials. The sealing clamp 200 is shown clamping the tubing behind the cutting tool 202. The forward end of the tubing, which is out of view in these drawings, is clamped at the forward end of the tubing by the other actuator group (e.g. 110). Accordingly, the section of tubing between actuator group 108 and actuator group 110, although clamped by sealing clamp 200 here at the rearward side of the system 100, is still under pressure. As will be shown, the holding clamp prevents sudden depressurization of the section of tubing being cut-off. The tools 200, 202 can be pneumatically or electrically actuated and are mounted on a plate 402 that is attached to a carriage 400 that moves along the track 104. As used here, the term "actuated" refers to the closing or opening of the end effectors that engage the tubing of the various tools. It can also refer to the moving of the tools for clearance when moving the actuator groups 108, 110 rearwards.

The tubing 300 can be provided on a spool 301, and a free end of the tubing 300 can be connected to a pressure source 302, such as a nitrogen gas source, that pressurizes the tubing to a specified pressure, such as through an adjustable pressure regulator 304. The working end of the tubing 300 is then fed through the apparatus to be cut, under pressure, into sections of a desired length. The cut sections of tubing, having been pressurized, have much less curve to them than if they had been cut without being under pressure as the pressure is sufficient to change the intermolecular tension in the polymeric material resulting from having been stored on a spool 301. It is further contemplated that the tubing can be provided directly from an expansion machine that expands the tubing, rather than from a spool. In either case, the tubing will have a free end that is either coming off the spool or out of the expanding machine, and a tail end at the other end of the tubing.

Figure 5:
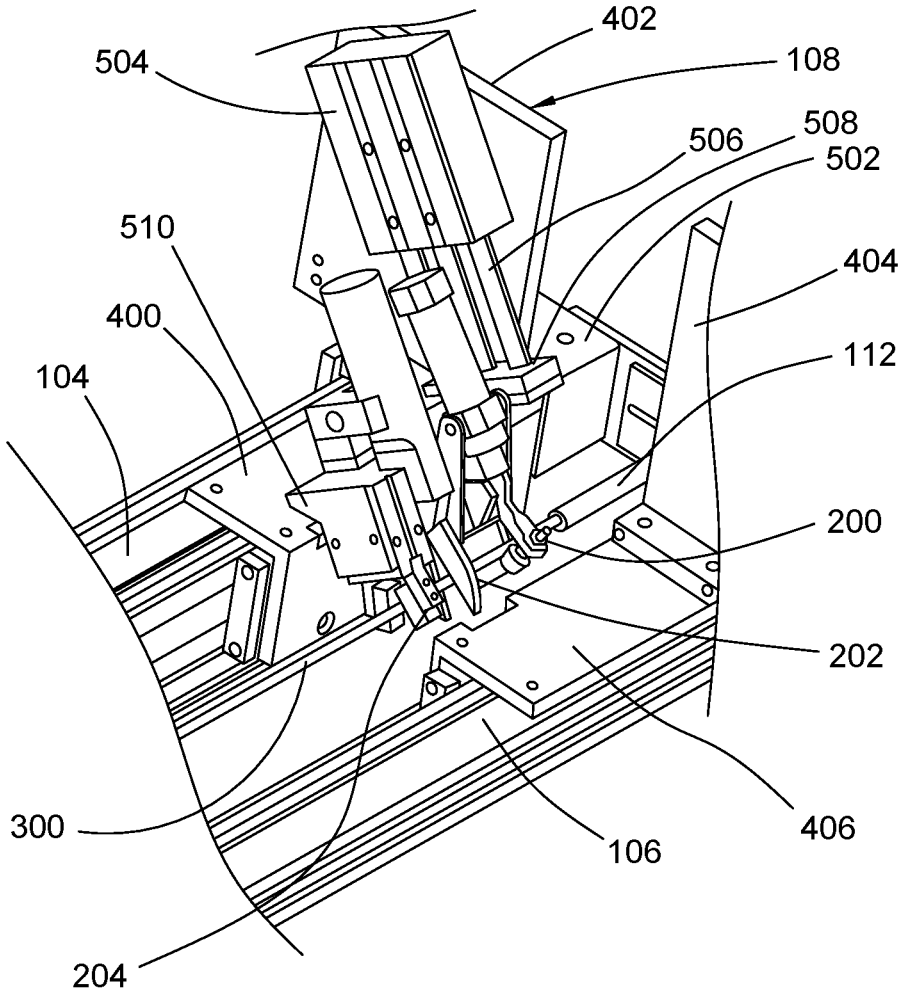
FIG. 5 is a detail view of an actuator group include both the sealing and holding clamps arranged on opposite sides of the cutting tool of the actuator group, in accordance with some embodiments.

FIG. 5 is a detail view of an actuator group including both the sealing and holding clamps arranged on opposite sides of the cutting tool of the actuator group, in accordance with some embodiments. In this view of the actuator group 108, the holding clamp 204 can be seen forward of the cutting tool 202 and sealing clamp 200. The sealing clamp 200 is configured to clamp the tubing 300 with enough force that the tubing behind the sealing clamp 200 (e.g. coming from the source of the tubing) remains sufficiently pressurized. The holding clamp 204 provides some sealing effect, but mostly holds the tubing to ensure a precise cut by the cutting tool 202, and releases pressure in the cut-off section of tubing. Both actuator groups 108 and 110 have a sealing clamp, cutting tool, and holding clamp as shown here.

These tools of the actuator group 108 are mounted on a frame 508 that is connected to a series of parallel shafts 506 that are moveable along their axis by position actuator 504. Wiring to control operation of each tool 200, 202, 204 and the position actuator 504 is carried by the actuator group 108. The position actuator 504 is electrically or pneumatically operable to move the shafts up or down, thereby raising or lowering the tools 200, 202, 204. The position actuator 504 is mounted fixedly on a vertical plate 402 that is mounted on a carriage 500. The carriage 500 moves linearly, along the track 104. In general, when the carriage 400 is in the position shown, abutting back stop 502 for example, the tools 200, 202, 204 are in the lowered position. The tools 200, 202, 204 remain in the lowered position as well as while the carriage 400 is moved forward (away from back stop 502) along the track 104. Prior to returning to the position shown from a forward position, the position actuator 504 is actuated to raise the tools 200, 202, 204 by drawing shafts 506 upward. Then the tools 200, 202, 204 are again lowered once the carriage 400 is in the home position.

Figure 6A:
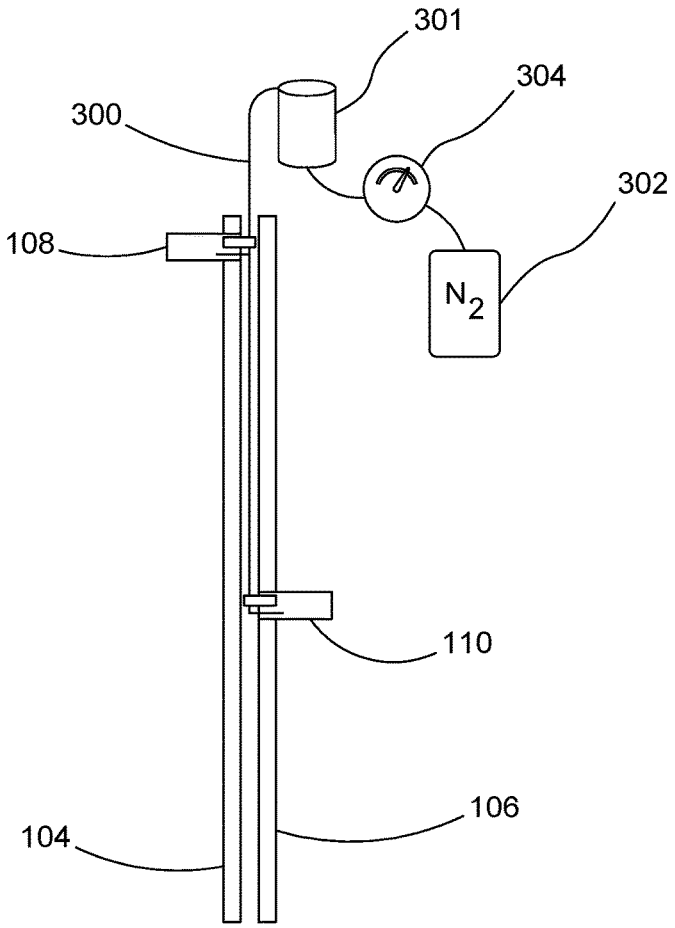
FIGS. 6A and 6B show alternating positions of the pair of actuator groups of a linear cut to length system for cutting tubing, in accordance with some embodiments.
Figure 6B:
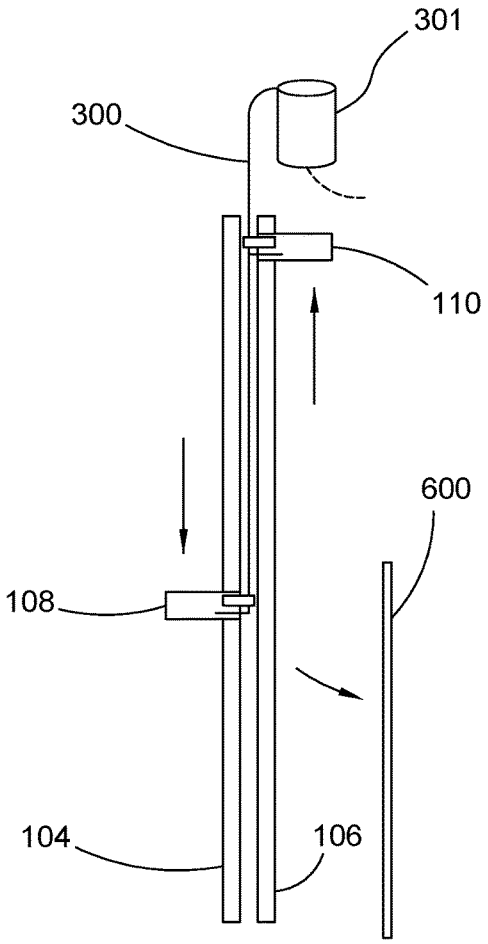

FIGS. 6A and 6B show an overhead view of system 100 in which alternating positions of the pair of actuator groups of a linear cut to length system for cutting tubing are shown, in accordance with some embodiments. In FIG. 6A, actuator group 110 has been lowered and clamped onto the tubing 300 and moved to a forward position such that the forward end of the tubing is at a distance from the location of the cutting tool of actuator group 108 which is the desired length of the tubing. Actuator group 108 in the home position is lowered until actuator group 110 approaches the desired length. As shown, the sealing clamp 200 of both actuator groups are closed, and the holding clamp 204 of actuator group 110 is released (i.e. open). Accordingly, the holding clamp 204 of actuator group 108 is closed to secure the tubing 300, the cutting tool 202 of actuator group 108 is operated to cut the tubing 300, and the holding clamp 204 of actuator group 108 is released to let out the pressurized gas in the cut-off section of tubing (500) in a controlled manner as to prevent the tubing 300 from rocketing as the gas pressure is released slowly. That is, the holding clamp 204 is slowly released to allow the pressurized gas inside the tube to escape slowly. In some embodiments, the holding clamp 204 is released from its fully closed state to its fully open state over 1-2 seconds of time. The sealing clamp 200 of actuator group 110 is then released to free the cut-off section 600 of tubing 300. Then with the sealing clamp 200 of actuator group 108 still engaged, actuator group 108 is moved forward, and actuator group 110 is raised and moved rearward, as indicated in FIG. 6B. During movement of actuator group 110 to the rear, the clamps and cutting tool can be raised so as not to interfere (contact) with the clamps and cutting tool of actuator group 108 and they pass by each other. A cut-off section 600 of tubing is produced by the operation of FIG. 6A, and in FIG. 6B the process is repeated with the roles of the actuator groups reversed. In FIG. 6B actuator group 110 does the cutting and sealing after actuator group 108 is moved to the correct point along track 104. The process is then alternated among the actuator groups 108, 110 to produce each successive section of cut-off tubing. The position of the forward actuator group is determined by the desired length of the cut-off section 500 of tubing, as input by a user (e.g. using controller 114).

Figure 7:
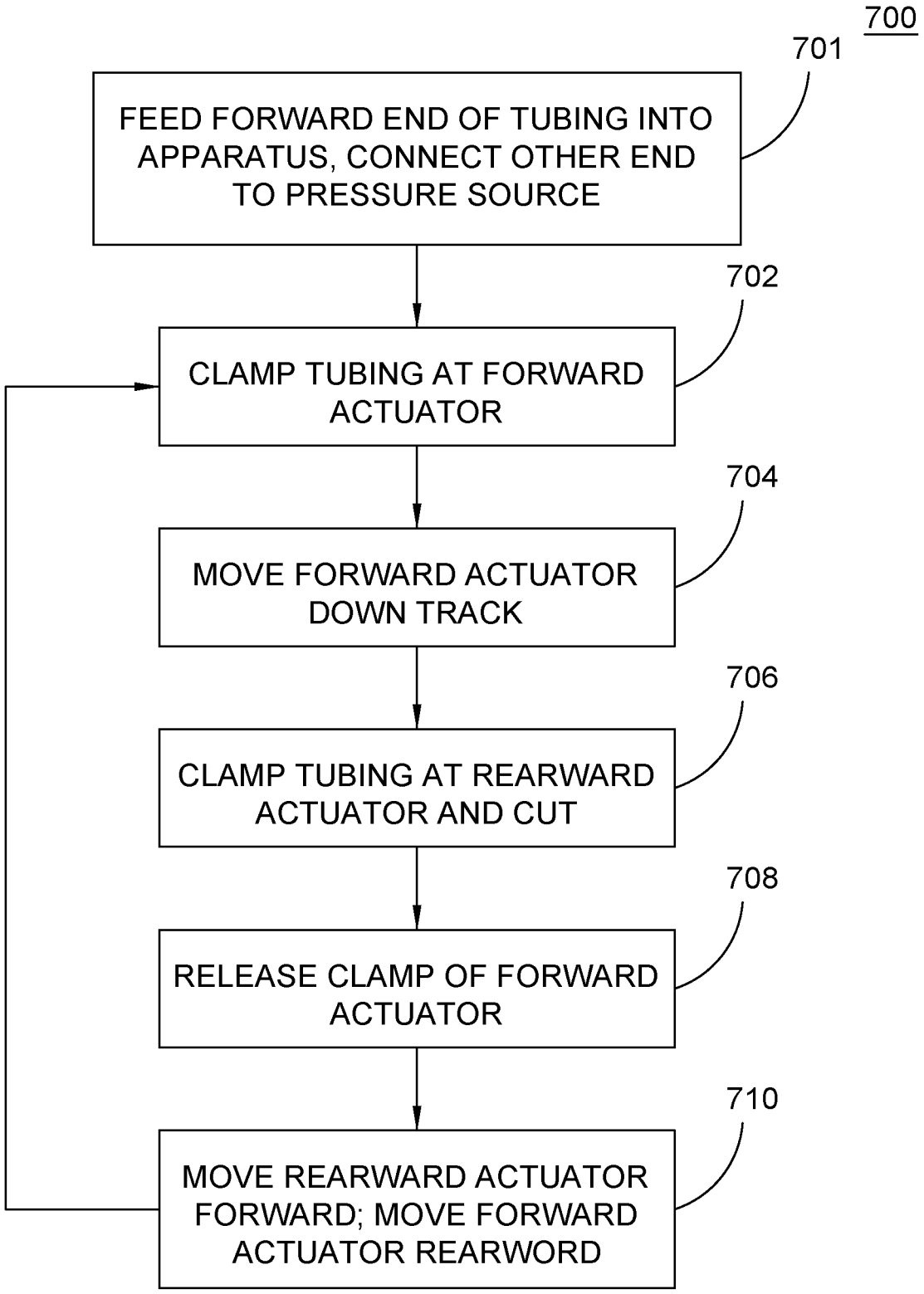
FIG. 7 is a flow chart diagram of a process for cutting tubing to length, in accordance with some embodiments.

FIG. 7 is a flow chart diagram of a process for cutting tubing to length, in accordance with some embodiments. In step 701 a source of tubing of the type described hereinabove is obtained. The tubing source has a free end that is fed into the apparatus and into position with the more forward actuator group. The other end of the tubing, the tail end, is connected to a pressure source, such as nitrogen gas, and the nitrogen gas is then released into the tubing to pressurize it above atmospheric pressure, and to a pressure level that is sufficient to stretch the tubing, radially, in order to prevent creasing or other deformation of the tubing during the process of cutting sections to a desired length. Of course, the pressure needs to be applied at a level lower than that which could damage the tubing and render it unusable. The source of the tubing can be a spool of tubing, or the tubing can be provided directly from the expansion machine creating the tubing.

In step 702 a forward actuator group (e.g. 108 or 110, whichever is forward) engages its sealing clamp (e.g. 200) on the pressurized tubing. In actuality, when a clamp is first applied to the free end of the tubing is when the tubing become pressurized as the gas being used to pressurize the tubing will simply be expelled from the free end until the free end is clamped. In step 704 the forward actuator group is moved on its respective track forward to a position such that the distance from the end of the tubing at the forward actuator group, which will be just forward of the forward actuator group's sealing clamp (about equal to the position of the cutting tool of the forward actuator group), to the location of the cutting tool of the rearward actuator group is at a desired length. Once the forward actuator group is in position, the sealing and holding clamps of the rearward actuator group are engaged, and the cutting tool of the rearward actuator group is then engaged to cut the tubing. After the tubing is cut by the rearward actuator group the holding clamp of the rearward actuator group can be released. The sealing clamp of the rearward actuator group is maintained in a clamped engagement to keep the tubing pressurized. In step 708, the sealing clamp of the forward actuator group is released to release the cut-off section of tubing. Then in step 710 the rearward actuator group, while maintaining its sealing clamp in a clamped engagement of the tubing, is moved forward, and forward actuator group, having been completely disengaged from the tubing, is moved rearward. In moving the forward actuator group rearward, the forward actuator group's clamps and cutting tool are raised or otherwise moved out of the way of the rearward actuator group to allow the actuator groups to pass by each other. The rearward actuator group, while maintaining its sealing clamp closed on the tubing, is then forward to the desired position, pulling the tubing with it. Once the positions of the actuator groups are swapped, the process is repeated; the previously forward actuator group is then the rearward actuator group, and vice versa.

Figure 8A:
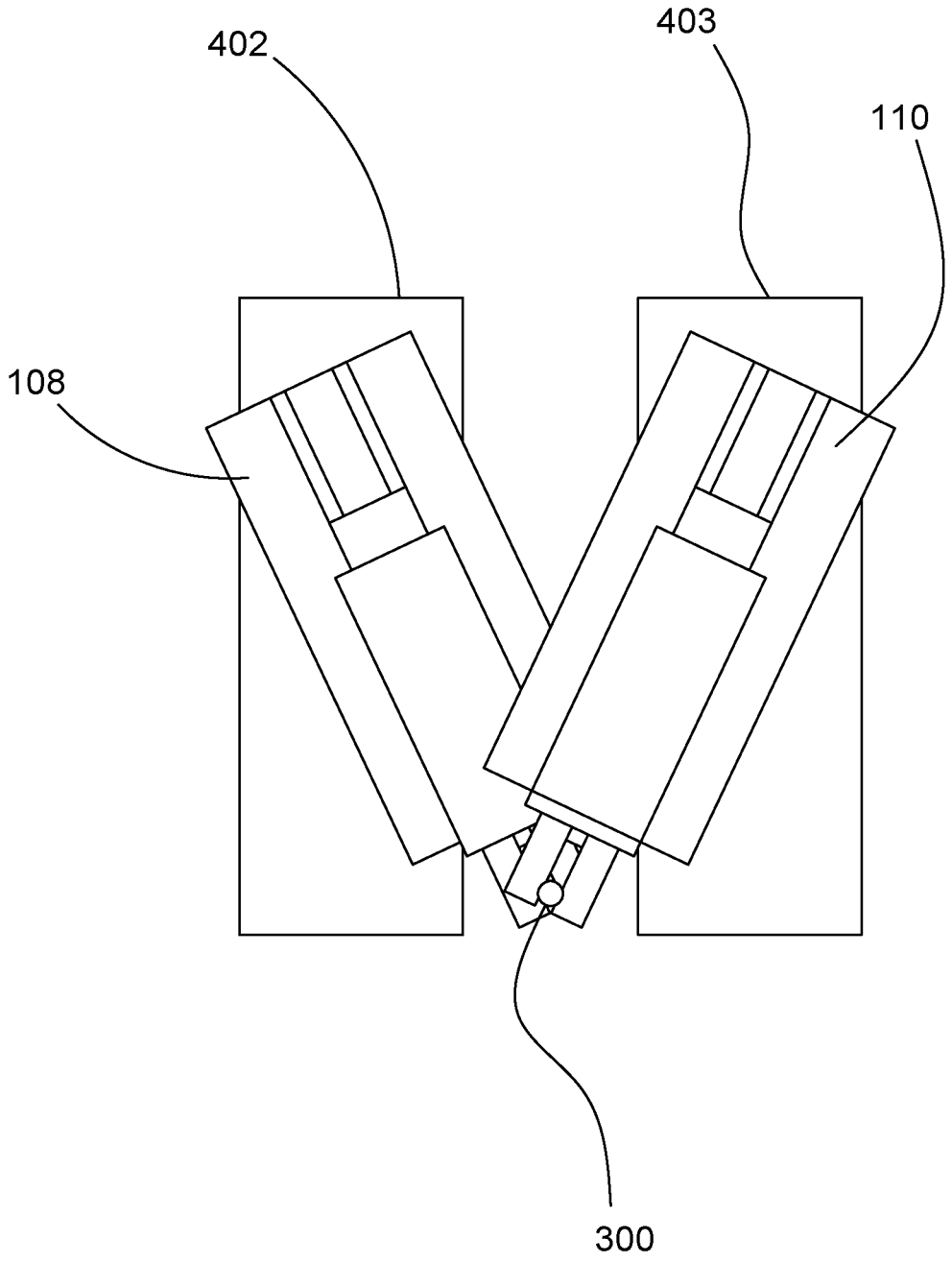
FIGS. 8A-8C show a front view of the actuator groups during a sequence of a cutting cycle, in accordance with some embodiments.
Figure 8B:
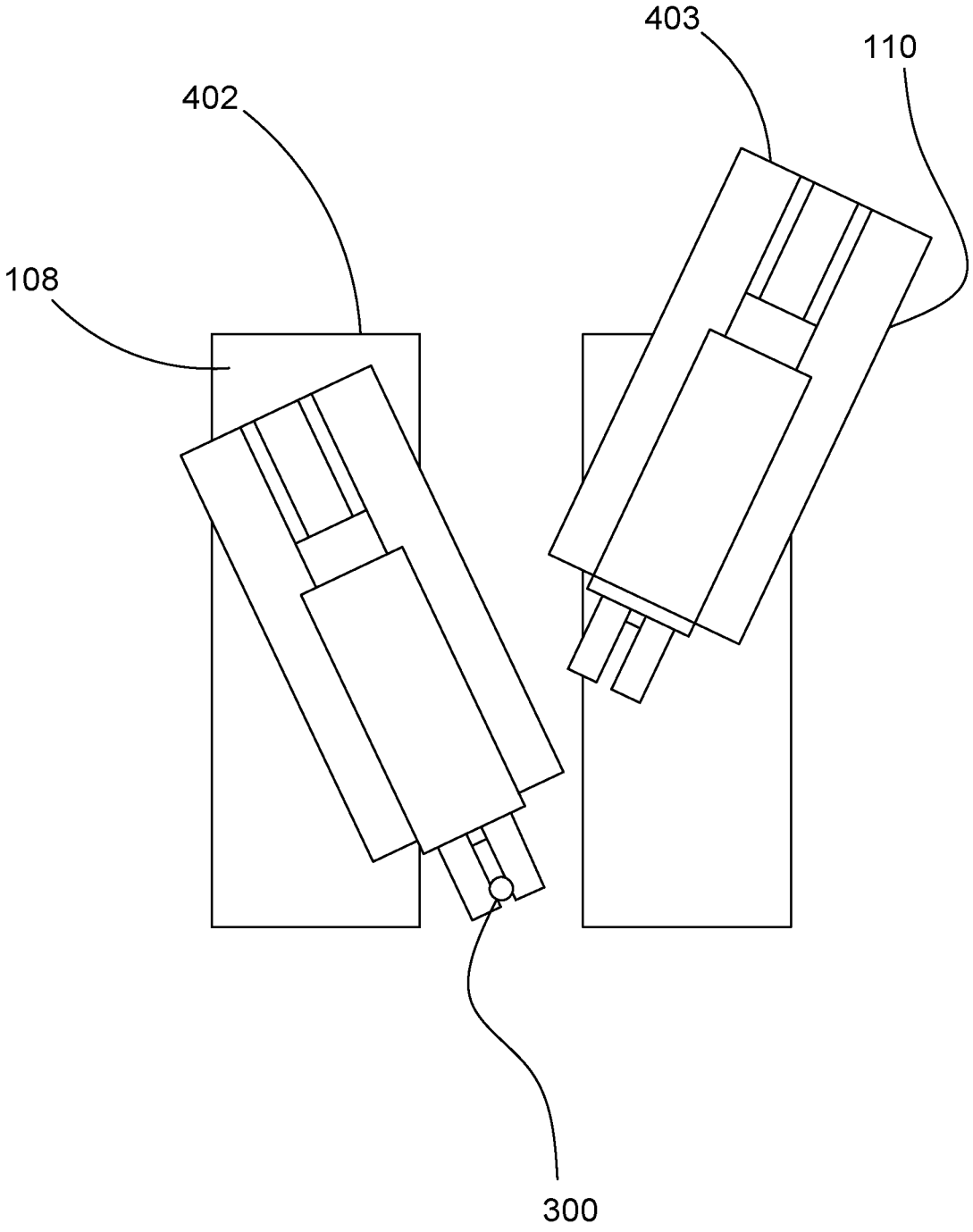
Figure 8C:
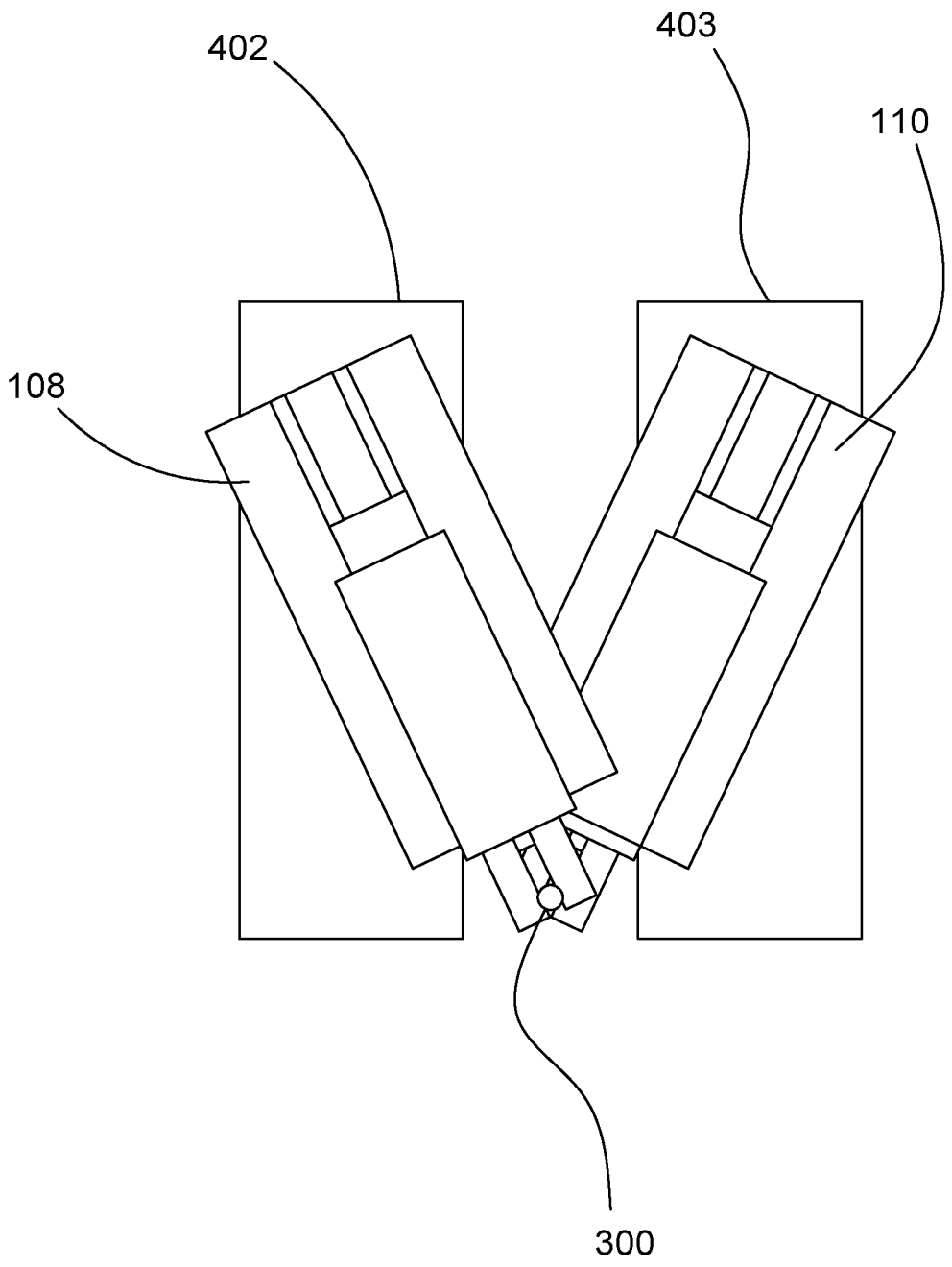

The process is shown in FIGS. 8A-8C from a front view of the actuator groups. In FIG. 8A, the second actuator group 110 is shown in the forward position, with the first actuator group 108 behind it. The sealing clamp of the second actuator group 110 is closed on tubing 300, as are both the holding clamp and sealing clamp of the first actuator group 108. The cutting tool of the first actuator group 108 then cuts the tubing 300. After the tubing is cut, the holding clamp of the first actuator group 108 is released while the sealing clamp of the first actuator group 108 remains closed. Likewise, the sealing clamp of the second actuator group is then opened to release a cut section of tubing (e.g. 600). In FIG. 8B it can be seen that the tools of the second actuator group 110 are raised. This allows the first actuator group, still clamping the tubing with its sealing clamp, to be moved to the forward position, and second actuator group to be moved to the rear or home position as shown in FIG. 8C. In FIG. 8C, the first actuator group 108 is in the forward position such that the distance from cut end of the tubing 300 to the cutting tool of the second actuator group 110 is the desired tubing section distance. The tools of the second actuator group 110 are then lowered. Then the holding clamp and sealing clamp of the second actuator group 110 are clamped onto the tubing. Then the cutting tool of the second actuator group 110 is actuated to cut the tubing again. The process is then repeated, with the actuator group 108, 110 moving back and forth to draw out and cut section of tubing under pressure. As seen here, the tools on each actuator group are each oriented at an angle with respect to vertical, and each of the actuator group 108, 110 are angled away from each other. If the actuator groups 108, 110 were commonly oriented, then a more complex movement and structure would be required to allow the two actuator groups to linearly reciprocate along their respective tracks without interfering with each other. Thus, it is preferred that the actuator group 108, 110 not be commonly oriented, and have some degree of opposition (e.g. tilt, angle) with respect to the axis of the tubing. Here the actuator groups each have a tilt of about thirty degrees from vertical in opposite directions, resulting in about a sixty degree offset between them. The actuator groups 108, 110 could be oriented 180° from each other so that they are directly opposing each other about the tubing. The tools 200, 202, 204 of each actuator group have a common operative position with respect to the axis of the tubing 300 so that the tubing 300 passes between the opposing jaw members of each tool so that they can each act on the tubing 300. The non-operative ends of the actuator groups 108, 110, which are opposite the operative position on each actuator group 108, 110, are angled away from the non-operative end of the other actuator group while maintaining the common operative position.

Figure 9:
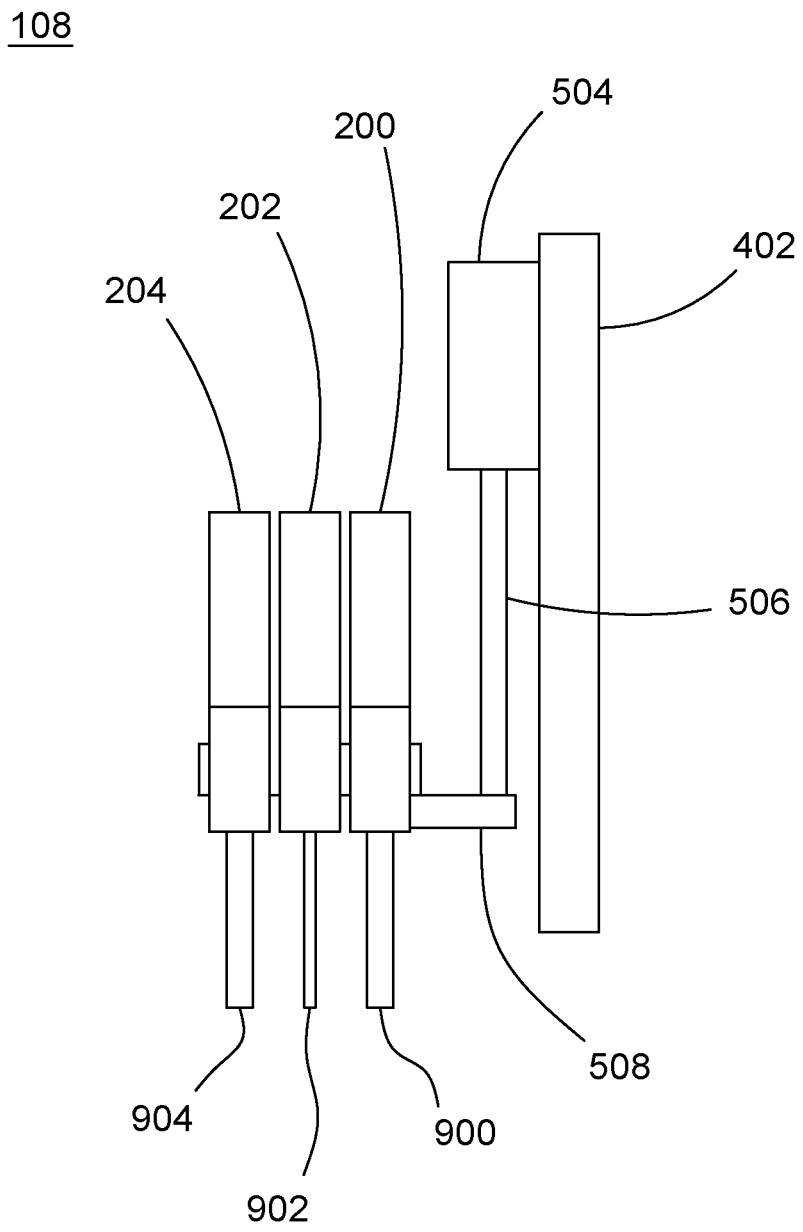
FIG. 9 shows a side view of an actuator group, in accordance with some embodiments.

FIG. 9 shows a side view of an actuator group 108, in accordance with some embodiments. The actuator group includes a vertical plate 402 or similar support structure on which the position actuator 504 is mounted. The position actuator 504 is operable to move one or more shafts 506 through the position actuator 504 along the axis of the shafts 506. The shaft(s) 506 is connected to a frame 508 on which the tools, including sealing clamp 200, cutting toll 202, and holding clamp 204 are mounted. Each of the tools 200, 202, 204 have a pair of jaw members 900, 902, 904, respectively, between which a section of tubing passes. Jaw members 900 and 904 present opposing flat surfaces on either side of the tubing, and when actuated the opposing jaw members 900, 904 come together to squeeze the tubing between them. The opposing jaw members 902 of the cutting tool 202 include at least one edged member that is oriented to that the edge cuts through the tubing. The opposing jaw members 902 of the cutting tool 202 can operate in a bypass/scissors cutting style, or one jaw member can present a flat surface against which an opposing edged jaw member is pressed to cut through the tubing. The vertical plate 402 can be mounted on a carriage (e.g. 400 in FIG. 5) which is attached to a track (e.g. 104) to move the actuator group 108 back and forth on the track as described.

A linear cut to length tubing cutting system has been disclosed that avoid the use of a pinch roller system to keep the tubing under pressure, but which also produces undesirable edge seams along the tubing. The inventive system disclosed herein uses to actuator groups that each have a holding clamp, and cutting tool, and a sealing clamp. Each actuator group is on a respective parallel track, and they are alternatively moved back and forth on their respective tracks to cut the tubing to a desired length while maintaining pressure in the tubing. Although certain embodiments have been disclosed herein, alternative and equivalent structures will occur to those skilled in the art that can be used in an interchangeable manner to accomplish the same function. For example, to raise the holding clamp, cutting tool, and sealing clamp, the carriage can raise the entire actuator group vertically, rather than using the position actuator to raise these tools.

What is claimed is:

1. A system for cutting tubing to a desired length, comprising:

a first track and a second track, wherein the first track and the second track are parallel to each other;

a first actuator group disposed on the first track, a second actuator group disposed on the second track, wherein the first and second actuator groups are movable, forward and rearward past each other, on their respective tracks between a home position and a forward position, wherein a distance between the home position and the forward position is equal to the desired length; and each actuator group having, from front to rear, a holding clamp, a cutting tool, and a sealing clamp; and wherein the first and second actuator groups are alternately moved forward and rearward past each other on their respective tracks while engaging a pressurized tubing to iteratively cut the pressurized tubing to a desired length.

2. The system of claim 1, wherein the holding clamp, cutting tool, and sealing clamp of each of the first and second actuator groups are moveable between an operative position and a raised position, and wherein when the first and second actuator groups are moved rearward the holding clamp, cutting tool, and sealing clamp are moved from the operative position to the raised position.

3. System of claim 2, wherein each of the first and second actuator groups has a non-operative end, and wherein the non-operative ends of the first and second actuator groups are angled away from each other and the operative position of the first and second actuator groups are maintained in common.

4. The system of claim 1, wherein the holding clamp, cutting tool, and sealing clamp of each of the first and second actuator groups are mounted together on a frame that is movable by a position actuator.

5. The system of claim 4, wherein the position actuator of each of the first and second actuator groups are mounted on a respective vertical plate that is further mounted on a carriage on the respective first and second tracks.

6. The system of claim 1, further comprising a control unit that is operably connected to each of the first and second actuator groups, which causes the first and second actuator groups to move on the first and second tracks, respectively, to control a distance between the first and second actuator groups to a desired cut tube length.

7. The system of claim 1, wherein the first and second tracks are mounted on a common frame.

8. A method for producing tubing sections of tubing from a source of tubing, comprising:

providing a first actuator group and a second actuator group that are each mounted on a respective frame and moveable along a linear direction parallel to each other, between a home position and a forward position, each of the first and second actuator groups having a holding clamp, a cutting tool and a sealing clamp, wherein the sealing clamp seals a tube to prevent depressurization and is rearward of the cutting tool;

feeding the pressurized tubing between the first and second actuator groups; and iteratively and reciprocally moving the first and second actuator groups such that one actuator group of the first and second actuator groups is moved forward to the forward position while the sealing clamp of the one actuator group is clamped onto the tubing, thereby pulling the tubing, and at another of the first and second actuator groups which is in the home position, clamping the sealing clamp onto the tubing and cutting the tubing with the cutting tool, and then moving the one actuator group at the forward position back to the home position while the one actuator group at the home position is then moved forward while maintaining pressure in the tube.

9. The method of claim 8, further comprising providing the tubing on a spool.

10. The method of claim 9, the method further comprises: pressurizing the tubing at a source of the tubing.

11. The method of claim 8, wherein reciprocally moving the first and second actuator groups further comprises raising the cutting tool and the sealing clamp of the one actuator group at the forward position as it is moved rearward.

12. The method of claim 8, wherein providing the first actuator group and the second actuator group comprises positioning the first and second actuator groups such that they have a common operative position with respect to the tubing, and wherein a non-operative end of each of the first and second actuator groups are angled away from each other.

13. The method of claim 8, wherein providing the first actuator group and the second actuator group comprises providing the first actuator group and the second actuator group each further having a holding clamp that is located in front of the cutting tool, and when in the home position, clamping the holding clamp onto the tubing with the sealing clamp to hold the tubing while the cutting tool cuts the tubing.

14. The method of claim 8, wherein feeding the tubing between the first and second actuator groups comprises passing the tubing through a feed guide.

15. A method for producing tubing sections, comprising:

providing a cutting apparatus having a pair of actuator groups including a first actuator group and a second actuator group, the first actuator group mounted on a first track and the second actuator mounted on a second track that is parallel to the first track, wherein the first and second actuator groups are alternately moved along the first and second tracks, respectively, past each other, between a home position and a forward position that is a distance from the home position, and each of the pair of actuator groups having a holding clamp, a cutting tool, and a sealing clamp, in order from front to back;

providing uncut tubing from a tubing source, wherein the uncut tubing is created by expansion, the uncut tubing having a free end and a tail end;

connecting the tail end of the uncut tubing to a pressurized gas source;

feeding the free end of the uncut tubing into the cutting apparatus;

at a forward one of the pair of actuator groups in the forward position, clamping at least one of the holding clamps or the sealing clamp onto the free end of the uncut tubing;

pressurizing the uncut tubing by the pressurized gas source;

while clamping at the forward one of the pair of actuator groups, with the uncut tubing being pressurized, moving the forward one of the pair of actuator groups along a linear track to a desired distance, thereby pulling the uncut tubing;

upon the forward one of the pair of actuator groups reaching the desired distance, at a rearward one of the pair of actuator groups, clamping both the holding clamp and the sealing clamp of the rearward one of the pair of actuator groups onto the uncut tubing;

while both the holding clamp and sealing clamp of the rearward one of the pair of actuator groups are clamped onto the uncut tubing, cutting the tubing with the cutting tool of the rearward one of the pair of actuator groups to produce a section of cut tubing;

after cutting, while maintaining the sealing clamp of the rearward one of the pair of actuator groups clamped on the uncut tubing, releasing the holding clamp of the rearward one of the pair of actuator groups and the sealing clamp of the forward one of the pair of actuator groups to release cut section of tubing; and after releasing the holding clamp of the rearward one of the pair of actuator groups, and while maintaining the sealing clamp of the rearward one of the pair of actuator groups clamped on the uncut tubing, moving the forward one of the pair of actuator groups rearward and moving the rearward one of the pair of actuator groups forward past each other whereby the rearward one of the pair of actuator groups becomes the forward one of the pair of actuator groups, and the one of the pair of actuator groups that was forward become a rearward actuator group.

* * * * *